United States Patent [19]

Uhlmann et al.

[11] 4,393,566

[45] Jul. 19, 1983

[54] PROCESSING OF COPPER TUBING

[75] Inventors: Otto Uhlmann, Burgdorf; Klaus-Peter Uhlmann, Bad Iburg, both of Fed. Rep. of Germany

[73] Assignee: Kabel-und Metallwerke Gutehoffnungshutte AG, Hanover, Fed. Rep. of Germany

[21] Appl. No.: 221,297

[22] Filed: Dec. 30, 1980

[30] Foreign Application Priority Data

Oct. 5, 1980 [DE] Fed. Rep. of Germany ..... 30036

[51] Int. Cl.[3] ..... B23P 17/00; B21B 9/00

[52] U.S. Cl. ..... 29/417; 72/38

[58] Field of Search ..... 72/38, 39; 29/417

[56] References Cited

U.S. PATENT DOCUMENTS 1,893,926 1/1933 Anderson ..... 72/38

FOREIGN PATENT DOCUMENTS 46-27652 of 1971 Japan ..... 148/11.5 C

*Primary Examiner*—Daniel C. Crane
*Assistant Examiner*—Steven Nichols
*Attorney, Agent, or Firm*—Ralf H. Siegemund

[57] ABSTRACT

Several lengths of tubing are interconnected either in advance by welding or brazing, or on-line by hollow plugs, and fed through an annealing furnace, a jacketing station, and a cutter, whereby flushing gas such as air, oxygen-enriched air, or an inert gas are sucked through the respective trailing end. The on-line, end-to-end connection can also be additionally used for tubings as prepared in advance and permits continuous processing, particularly combining process annealing with removal of oil residues.

26 Claims, 2 Drawing Figures

PROCESSING OF COPPER TUBING

BACKGROUND OF THE INVENTION

The present invention relates to the processing of copper tubing; and more particularly, the invention relates to such processing following drawing and sizing.

It is known to process copper tubing for purposes of sizing by means of press-working and rolling followed by drawing under utilization of a drawing oil. The finished tubing is then heated in order to evaporate that oil, which procedure requires, of course, the removal of the oil vapor from the interior of the tubing. The removal in question involves, in particular, also the removal of carbon-containing deposits in the tubing. Such deposits may result from annealing of a tube. German printed patent application Ser. No. 26 17 406 proposes heating of the tubing to about 500° to 550° centigrade and passing of a carrier gas through the tubing, capturing and removing the oil vapor. Subsequently, the tubing is heated to 650° C., for an extended period of time for purposes of soft-annealing, i.e. process annealing, because it is desirable to render the tubing soft and readily bendable, a feature that is needed for installations in homes and the like. This particular method is quite suitable, especially as far as the removal of oil vapor deposits is concerned; but it cannot be carried out on a continuous basis and is, thus, not economical.

DESCRIPTION OF THE INVENTION

It is an object of the present invention to provide a new and improved method and equipment for removing oil and other carbon or carbon-containing deposits from the interior of a copper tube.

It is a particular objective of the present invention to provide a new method and equipment for removing such deposits in tubing, in a continuous process.

It is a further object of the present invention to provide a new and improved method and equipment for processing copper tubing following sizing-by-drawing.

It is a particular object of the present invention to remove drawing oil and related residue from copper tubing.

In accordance with the preferred embodiment of the present invention, it is suggested to interconnect tubes, e.g., by means of hollow plugs, pass the resulting string of tubing through a heating stage for annealing in which the temperature is raised to an annealing temperature, well above the evaporation temperature of the oil deposits to be removed and to blow or suck the resulting vapors out of one end of that string of tubing. In the preferred form of practicing the invention, the tube is jacketed downstream from the annealing station while the tubing is being straightened just ahead of the annealing. Thus, these steps are carried out on a continuous basis, just as long as one adds new tubing to the string. There is, however, always at least one open end of the tubing through which the vapors that develop in the annealing station are removed. The oil vapors are preferably sucked through the trailing end of the not yet processed tubing, while, for example, air, or air enriched with oxygen or a protective inert gas (nitrogen), is fed into the front end of the tubing. The choice of flushing gas depends upon the conditions and requirements. The flushing gas may be heated so that it will not interfere with the annealing by unduly chilling the tubing. The front end through which flushing gas enters is, in effect, newly formed, intermittently as the usual lengths are cut from the jacketed tubing. Oxygen is used to remove (burn off) carbon and carbon-containing residue so that the process does not just depend upon evaporation. The copper oxide layer may form if oxygen is used in excess. Excess oxygen ensures complete burn-off of carbon while a copper oxide layer is harmless. The velocity of the flushing gas through the tubing should be well in excess of the travel speed of the tubing through the production line. The gas velocity is preferably five times the speed of the tubing.

The tubing, e.g., copper tubing annealed at 600° C., or more, is quite flexible and clean. Process annealing is carried out by means of inductive or conductive heating. Oil and other residues, such as reaction products of cracking, have been removed at the same time.

From some points of view, it would be preferable to blow air or gas into the trailing end of the tubing; but it was found that, if the gas or air speed is too low, the oil may condensate and redeposit in the tubing, downstream from the heater. It is, thus, preferred to apply suction to the trailing end; the oil may also recondensate, but that will occur in those tube portions not yet processed. Thus, the residue to be removed is shifted upstream and will, ultimately, be removed. In practice, copper tubing that leaves the last size drawing stage (in which the oil is deposited) comes in lengths of, say, 400 meters. Such tubing may have a size of 15 by 1 (mm) and is to be cut to lengths of from 25 m to 50 m after jacketing. The 400-meter-length tubings are interconnected by hollow plugs whereby suction is temporarily halted as two such tubing strings are being interconnected while the suction device is switched from one to the other. Thereafter, the suction power should be increased temporarily above normal levels in order to ensure consistent removal of vapors. The processing of the tubing is not interrupted by this switch-over. Moreover, the switch-over period may be "bridged" by front end blowing and/or by applying suction to the trailing end of the new as well as of the old tubing, as well as to the zone in which the front end of the new tubing is connected to the rear end of the old one. Whenever a protective gas is used for flushing, it may be advisable to stop suction a little before cutting and to resume suction only after the newly cut front end is connected to the source of the protective gas. One may even change from suction to blowing at the trailing end in order to avoid ingress of oxygen at the cutting zone. In other cases, certain tube lengths may be welded or soldered together to form a long string (e.g., several kilometers long) and to be treated as stated. This, then, amounts to a quasi-continuous process that lasts for several, even many, hours. This long string may, however, be connected to another one, having been prepared in the same manner (welded, soldered); and now this new long string is plugged into the end of the first one, and so forth, to again achieve true continuity. A truly continuous process within the purview of the invention is one which can be carried out in an endless fashion. Any interruption is an arbitrary one and not dictated by finite lengths of stock being worked.

It can thus be seen that the invention resides in combining a continuous process annealing with residue removal, whereby a long string of tubing is either produced on a running basis by front end-to-trailing end connections through a hollow plug and as the process continues, or by preparing a very long string of tubing through welding or brazing lengths of tubing together, or by a combination of both, i.e., by on-line plugging together long strings of brazed or welded-together tubings. Suction is always applied to the trailing end of the tubing or string of tubing that currently passes through the production line while the front ends are newly generated as shorter lengths are cut from the string and care is taken that the respective new front ends are, indeed, the intake for whatever flushing gas one wants to insert.

DESCRIPTION OF THE DRAWINGS

While the specification concludes with claims, particularly pointing out and distinctly claiming the subject matter which is regarded as the invention, it is believed that the invention, the objects and features of the invention, and further objects, features and advantages thereof, will be better understood from the following description taken in connection with the accompanying drawings, in which:

Figure 1:
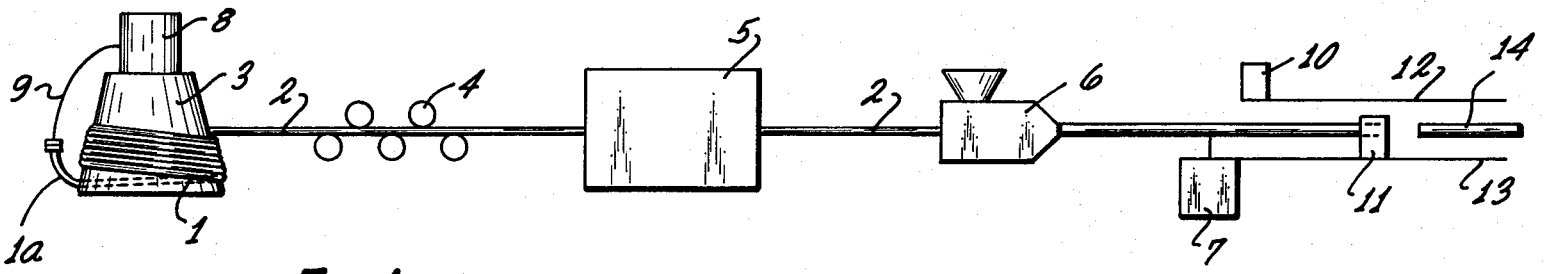
FIG. 1 is a schematic representation of a device for practicing the method in accordance with the preferred embodiment of the invention.

Proceeding now to the detailed description of the drawings, coiled copper tubing 2 is available as a bunch 1 on a rotating cone 3. This copper tubing may be a string of, say, 400-meter length. It has been passed through several stages, including a final drawing stage for sizing. Previously, the tubing has been made by rolling or pressing, or the like. The drawing process, particularly the final sizing step, used oil as a lubricant, and residues of that oil is contained in and deposited on the inside wall of the tubing.

The tubing 2 is taken from store 1,3 and passes through a set of straightening rollers 4 which, in turn, feeds an annealing furnace 5. The furnace is constructed for continuous passage and resistive heating of the tubing passing through. The temperature of the tubing is raised by that heater to at least 600° C. Inductive heating could be used in the alternative.

Tubing 2 emerging from furnace 5 cools slowly in the air, commensurate with the process annealing for softening of the copper, and passes through an extruder 6 which jackets the tubing in a synthetic envelope. The station 6 should be placed from heater 5 at a distance which ensures that the tubing 2 is not unduly hot to avoid possible decomposing or charring of the synthetic being extruded. Proper placement ensures that the tubing has a temperature most suitable for receiving the extruded jacket.

A flying saw or cutter 7 is disposed downstream from the extruder for cutting the tubing into customary lengths, such as 25 or 50 meters. A cut-off tube length, such as tube 14, is removed by means of a roller track and is, possibly, fed to a coiler, for further storage in a manner suitable for transport in not too bulky a configuration.

The particular coil 1 at the input side has an end 1*a* which is connected in a quick release fashion to a flexible feed line 9 of a suction pump or a blower 8. This blower or pump sits on the cone 3 and rotates therewith. Assuming the device 8 operates by means of suction, it will suck vapors from the interior of the tubing, particularly as generated in the heater 5. Due to cutting and sawing, there is always an open end at some point downstream from the extruder 6, and air can readily be sucked into that open end. In addition to carrying off the oil vapor, any carbon deposit is burned off by the oxygen of the air and carried away as a carbon oxide. Such carbon deposits may result from cracking or charring of oil in the hot furnace or may have been produced in earlier process stages. In any event, any carbon deposit in the tubing will burn off in the heater 5, and the resulting carbon oxide product is also sucked out of the tubing by means of device 8.

It should be noted specifically that the residue removal process is carried out in a direction, as far as air flow is concerned, opposite the process progression. This is important because it prevents any residues from being blown into the annealing zone proper or even into the zone of cooling downstream from furnace 5. Thus, any secondary deposit resulting, e.g., from precipitation or condensation of removed oil will occur only in tubing portions not yet processed so that its removal is merely deferred.

Experience has shown that the air velocity inside the tubing should exceed twice the speed of the tubing through the process stages. Preferably the air speed should have the fivefold value of the tube's speed to ensure sucking-up of most of the vapors.

It is possible that the regular oxygen content in air is not sufficient. Particularly, complete carbon removal (the content may vary) requires stoichiometric excess of oxygen so that it may be advisable or even necessary to enrich the air being sucked in, with oxygen. The system includes two chambers 10 and 11, respectively running on rails 12 and 13, parallel to the travel path of the tubing and of the flying saw 7. These chambers can be pivoted into and out of the travel path of the tubing. Chamber 11 is depicted as being in the path and travels with the cut front end of the tubing in connection therewith. Chamber 10 is held in readiness in order to be connected to a new front end whenever the cutter 7 has severed a length of the string.

Air enriched with oxygen is fed into the chambers, particularly the one being currently connected to the end of the tubing (i.e., chamber 11) so that such enriched air is sucked through tubing 2, enhancing the purification and cleansing process. Following the next cut, chamber 10 is connected to the new end, chamber 11 releases the tube and is returned on rail 13 while chamber 10 advances with the tubing.

It should be noted that additional blowing may be provided by and in chambers 10 and 11, to blow the oxygen-enriched air into the tubing, i.e., to assist the suction at the other end. Such supplemental blowing of oxygen-enriched air into the front end of the processed tubing may be a normal flushing assist, supplementing the suction; or it may be limited (or increased in intensity) during the connecting operation to be described next. Another aspect to be mentioned is that the chambers may be provided for reheating the air and/or oxygen before it is fed into the tubing in order to avoid internal chilling by the flushing gas which passes through the annealing zone of the tubing in the heater 5.

After a certain period of time, the coil 1 has been exhausted and the trailing end 1*a* is about to be drawn off store 1,3. This requires the following four steps to be taken. First, the quick release coupling disconnects the feed tube 9 from this trailing end 1*a;* second, a new coil is put into place; third, the front end of the latter is connected to the trailing end (1*a*) of the tubing that is just about completely processed. This connection is made by means of a hollow plug which, however, is readily capable of transmitting traction tension from one (the old) tubing to the new one. The fourth and final step resides in connecting the feed tube 9 to the rear end of the fresh bunch of tubing. Due to the continued or resumed suction, air, possibly enriched with oxygen, passes through the tubing, particularly that portion running through the heater as well as through the hollow plug and the new tubing, to be sucked out of the system.

In order to speed up the process, one may use two feed lines such as 9, being separately controlled by valves. The second feed line is connected to the trailing end of the new tubing; as soon as its front end is connected to the trailing end of the tubing that was just disconnected, one turns on the valve of the second feed line in order to obtain suction and to continue with the residue removal process, possibly even at a higher rate at first, for ensuring complete removal of vapor, and so forth, that developed during the switch-over. The disconnect-reconnect method can actually be refined in the following manner. The front end of the new tubing is placed into a suction chamber; so is the joint between feed line 9 and trailing end 1*a*. Now, the latter connection is released while suction continues. Moreover, the second feed line from pump 8 has been connected earlier to the other trailing end of the new tubing, and the valve has been opened to already suck from that end. Thus, suction continues throughout, particularly during the period of making up the connection of the two tubings to each other. Suction at that joint is removed thereafter, but suction is continues at the trailing end of the new tubing in order to now run through the plug connection between the tubings.

In either case, it is advisable to increase the suction power to some extent, possibly considerably, following this connecting operation, to make sure that no stagnation occurs or that excess vapors develop more toward the front.

As was mentioned above, but particularly in conjunction with possible oxygen enrichment, air or air/oxygen may be forced into the tubing from the front end. Such blowing, or an increase in front end blowing, may suffice to bridge the period of disconnection of the sucking equipment at the trailing end so that one may just disconnect the feed line 9 from trailing end 1*a*, interconnect the two tubings, the reconnect feed line 9 to the trailing end of the new tubing. This procedure requires, of course, that the latter disconnect and reconnect process can be carried out in a period of time in which the current front end remains connected to one and the same chamber, 10 or 11, as the case may be. The blowing power from the respective chamber may actually be increased during the trailing end disconnect and reconnect procedure to ensure flushing throughout.

Another aspect that should be mentioned is that in between annealing and jacketing, the tubing may be subjected to another drawing step for obtaining semi-rigid tubing if that is desired.

Figure 2:
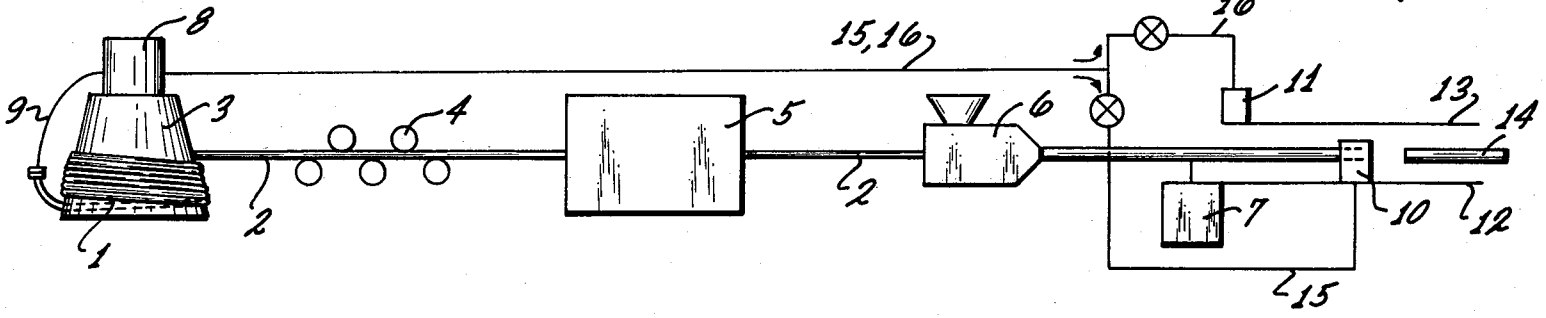
FIG. 2 is a similar representation for a modified method, still constituting a preferred embodiment.

In the case, one wants to make metallic bright copper tubes, excess oxygen must not be sucked through. Rather, a protective gas is needed for flushing oil vapors out of the tubing. The system shown in FIG. 2 includes most of the structure shown in FIG. 1, but the chambers 10 and 11 are not used to provide oxygen-enriched air. Rather, conduits and tubing 15 and 16 complete the separate circulation paths to the blower 8 so that, through one or the other of the chambers 10 and 11, a closed flow system is established for circulating protective gas. Filters are included in these connections 15 and 16, or on the intake side of the chambers 10 and 11, in order to remove the oil vapors and oil droplets from the carrier gas.

In order to maintain a closed system in all instances, certain precautions have to be taken. While cutting (sawing) is in progress, the blower should be turned down or even turned off to avoid that air enters the circulation through the gap created by the cutting. It may even be advantageous to reverse the flow of protective gas a little so that the interior tube zone adjacent to the cutting is, indeed, kept free from air. After the freshly cut front end of the tubing has been connected to the other chamber (10 or 11, as the case may be), the flow may be reversed. In consenance with the foregoing, the closed flow system of protective gas should maintain an excess pressure (above atmospheric pressure), at least in the tubing portions that are in the processing stages.

The operations described with reference to gas flow during switch-over at the front end and during cutting can be dispensed with if the entire equipment (or at least the cutter) is housed in a chamber that contains the protective gas. However, such a procedure is too expensive.

The refined method alluded to above and concerning the reconnect procedure of the sucking equipment is also applicable here in order to make sure that the sucking does cease during the trailing end reconnection and switch-over from the "old" to the "new" tubing. This may involve, in particular, blowing positively protective gas into the front end. Alternatively or additionally, suction is continued at the trailing end or ends throughout the switch-over process as has been described earlier. It should also be mentioned that the protective, inert gas may be heated before it is fed into the tubing in order to avoid interference with the annealing. Also, the hotter the flushing gas is, the less likely it will be that the vaporized material recondensates.

The figures facilitate and permit also the description of another embodiment for practicing the invention. It may be assumed that individual copper tubing is available at a length of 1500 meters having, e.g., an outer diameter of 12 mm and a wall thickness of about 1 mm. Several lengths of these tubes are end-to-end interconnected by brazing or welding. The inner diameter of the joint should not be significantly smaller than the inner diameter of each tube so that the passage of the flushing gas is not impeded. For example, eight of such lengths may be so interconnected, and the resulting string will permit four hours of continuous processing, assuming the processing rate is approximately 50 m/min.

The open front end of this long tube is now squeezed together, permitting but little passage of air. The other end of that long tube is connected to a suction line, such as feed line 9, and now the interior of the tubing is evacuated. Due to the front end closure, low pressure is generated in the tubing and that facilitates the evaporation. The tubing passes through the straightening rollers, 4, and a resistance or inductive annealing furnace, such as heater 5. This heater heats again the tube up to 650° C., but evaporation of oil begins earlier, at 500° C. or even at lower temperatures, on account of the reduced pressure.

The tube is jacketed and cut as described, and the cut lengths are also removed as described. However, the freshly cut end of the tube, upstream of the cutting, is squeezed again in order to drastically reduce the cross section of this newly formed entrance. This way, low pressure conditions will readily prevail in the tube, facilitating the removal of oil vapors. Again, at least some oxidation will occur; but primarily, the surface of the tube will be substantially freed from carbon.

It was found that the carbon concentration in water passing through the tubing, after having been installed and used, is less than 0.05 mg carbon per $dm^2$. Thus, the danger of corrosion of the tube through certain types of water is drastically reduced.

The squeezed-shut ends of the tubing can readily be opened by a hammer blow, or the like, particularly for inspecting the interior, to make sure that the adjusted operating conditions yield the desired results.

This mode of operation can also be carried out under utilization of protective gas. Moreover, after the rather long string of welded- or brazed-together tubing has been processed, another, similarly long string may be connected to the end of the first string. The same techniques, outlined above, can be used here to bridge the period in which there is no, or very little, suction at the respective trailing end. Also, following the on-line connection, suction power should be temporarily increased. Further, one can blow into the tubing from the leading-end or front end during the trailing end connection to make sure that the vapor removal continues just as the annealing continues.

The invention is not limited to the embodiments described above; but all changes and modifications thereof, not constituting departures from the spirit and scope of the invention, are intended to be included.

We claim:

1. A method of processing copper tubing having been drawn to final size under utilization of a drawing oil, comprising the steps of providing a plurality of such copper tubing;

interconnecting these tubings in a gas-conductive manner in order to form a long, continuous, string of tubing;

continuously passing the string of tubing through an annealing furnace, to heat the tubing to an annealing temperature, well above an evaporation temperature of the oil as was residually deposited inside the tubing; and removing resulting vapor continuously through an unconnected end of the tubing.

2. A method as in claim 1, including the step of connecting a front end of one of the tubings to a trailing end of another tubing while switching the removing step from the said trailing end to a trailing end of the one tubing.

3. A method as in claim 1, wherein the removal step includes applying suction to the unconnected end.

4. A method as in claim 3, including the step of squeezing shut a leading end of the string of tubing.

5. A method as in claim 3, wherein a leading end of the string of tubing is connected to a source of flushing gas pressure.

6. A method as in claim 2, wherein the removal step includes applying suction to the trailing end, but reducing or removing the suction during the switching.

7. A method as in claim 1, including the step of connecting the tubings by means of hollow plugs during the process, and in each instance as the trailing end of a tubing is about ready to be annealed.

8. A method as in claim 1, wherein the string of tubing is made prior to the annealing and removal steps, further including cutting the string of tubing in lengths, and squeezing almost shut the respective new front end.

9. A method as in claim 8, wherein the tubings are soldered together to form the string of tubing.

10. A method as in claim 1, wherein air is sucked into a front end of the tubing being annealed, air being sucked out of the trailing end.

11. A method as in claim 10, including the step of enriching said air with oxygen.

12. A method as in claim 1, including the step of feeding a protective gas to a front end of the tubing being annealed, protective gas being sucked out of the trailing end.

13. A method as in claim 12, including the step of recirculating the protected gas.

14. A method as in claim 13, including the step of filtering the recirculated gas.

15. A method for processing copper tubing following sizing under utilization of a drawing oil, comprising the steps of passing copper tubing through a furnace for annealing, whereby drawing oil deposits evaporate;

applying suction to the trailing end of the tubing so that evaporated oil deposits are removed through said trailing end; providing another such tubing having a front and a trailing end;

connecting the front end to the trailing end of the first-mentioned tubing under utilization of a hollow plug in order to obtain a string of tubing;

applying suction to the trailing end of the other tubing so that vapors can be removed through the latter's end;

continuing the annealing during the connecting step, and repeating the providing, connecting, and applying steps to obtain a continuous process on a continuous string of tubing; and cutting the resulting, continuous string of tubing into shorter lengths.

16. A method of processing copper tubing following sizing under utilization of a drawing oil, comprising the steps of providing a plurality of such tubings;

interconnecting them end to end by means of one of the following brazing and welding, resulting in a string of tubing having a leading end and a trailing end;

annealing the string of tubing gradually from the leading end to the trailing end, whereby oil deposits are evaporated;

continuously applying suction to the trailing end of the string of tubing in order to remove evaporated oil; and cutting the string of tubing into shorter lengths following the annealing.

17. A method as in claim 1, 15 or 16, wherein the annealing temperature exceeds 600° C.

18. A method as in claim 1, 15 or 16, wherein the flushing gas is an oxydizing gas.

19. A method as in claim 3, 15 or 16, wherein the suction provides a flushing gas speed through the tubing in excess of twice the speed of the tubing during the annealing.

20. A method as in claim 1, 15 or 16, wherein a flushing gas is applied under positive pressure through the leading end of the tubing, at least during the connecting.

21. A method as in claim 15 or 16, including the steps of applying a flushing gas to a cut front end by means of a flying source, applying such flushing gas from a different source to a next, cut front end while the first-mentioned source is returned to a starting position.

22. A method as in claim 21, wherein the flushing gas is oxygen-enriched air.

23. A method as in claim 21, wherein the flushing gas is a protective, inert gas.

24. A method as in claim 12, including the step of heating the protective gas.

25. A method as in claim 8, wherein the tubings are welded together to form the string of tubing.

26. A method as in claim 23, including the step of heating the protective gas.

* * * * *